US008485478B2

(12) United States Patent
Luetzow

(10) Patent No.: US 8,485,478 B2
(45) Date of Patent: Jul. 16, 2013

(54) SYSTEM AND METHOD FOR SERVICING A BREAKAWAY GATE

(75) Inventor: Edwin J. Luetzow, Brookings, SD (US)

(73) Assignee: MTR, Inc., Brookings, SD (US)

( * ) Notice: Subject to any disclaimer, the term of this patent is extended or adjusted under 35 U.S.C. 154(b) by 207 days.

(21) Appl. No.: 12/944,627

(22) Filed: Nov. 11, 2010

(65) Prior Publication Data

US 2011/0113690 A1 May 19, 2011

Related U.S. Application Data

(63) Continuation-in-part of application No. 12/001,104, filed on Dec. 10, 2007, now Pat. No. 8,240,618.

(51) Int. Cl.
*B61L 23/00* (2006.01)
*E01F 13/00* (2006.01)

(52) U.S. Cl.
USPC ..... 246/111; 49/9

(58) Field of Classification Search
USPC ..... 246/111–113, 114 A, 473 R, 473.1, 246/477; 49/9, 49, 141
See application file for complete search history.

(56) References Cited

U.S. PATENT DOCUMENTS

| | | | | |
|---|---|---|---|---|
| 4,219,969 | A | 9/1980 | Reinitz et al. | |
| 4,897,960 | A | 2/1990 | Barvinek et al. | |
| 5,442,878 | A | 8/1995 | Flores | |
| 5,992,800 | A | 11/1999 | Sass | |
| 6,327,818 | B1 | 12/2001 | Pease | |
| 6,470,626 | B2 * | 10/2002 | Luetzow et al. | 49/9 |
| 6,672,008 | B1 | 1/2004 | Luetzow | |
| 6,966,146 | B2 | 11/2005 | Pease | |

OTHER PUBLICATIONS

"U.S. Appl. No. 12/001,104, Non-Final Office Action mailed May 25, 2010", 7 pgs.
"U.S. Appl. No. 12/001,104, Response filed Sep. 21, 2010 to Non Final Office Action mailed May 25, 2010", 12 pgs.

* cited by examiner

*Primary Examiner* — R. J. McCarry, Jr.
(74) *Attorney, Agent, or Firm* — Schwegman, Lundberg & Woessner, P.A.

(57) ABSTRACT

Some methods include rotating a crossing gate actuator around a vertical swing pivot of a crossing gate mount, along a vertical swing path and into a down position to block a path such that a crossing gate coupled to the crossing gate actuator blocks the path, with a spring biased crossing gate release mechanism maintaining the crossing gate in a center position blocking the path and decoupling a bar segment from the crossing gate to decouple a spring from biasing the crossing gate into the center position such that the crossing gate is free to swing around a horizontal swing pivot, perpendicular to the vertical pivot, and out of the path.

20 Claims, 13 Drawing Sheets

SYSTEM AND METHOD FOR SERVICING A BREAKAWAY GATE

PRIORITY CLAIM

The present application is a continuation-in-part of U.S. patent application Ser. No. 12/001,104, entitled, "Multiple Direction Railroad Gate Release Mechanism," filed Dec. 10, 2007, the entire specification of which if incorporated herein by reference in its entirety.

FIELD

Embodiments are related to a gate release, and in particular, to a system and method for servicing a breakaway gate.

BACKGROUND

Paths, such as paths crossing a railroad track or grade, are sometimes guarded by one or more crossing gates or gates that are stored vertically when not in use and that are rotated down to a horizontal position in use to block the path. The crossing gates warn people on the path of hazards crossing the path, such as a train, and physically place a barrier across the path to discourage people from crossing. In railroad examples, motorists may drive into or impinge either the front or the back of the crossing gate to the extent that damage may occur to the crossing gate or the car. In some situations, the motorist may drive around a first crossing gate but impact a second crossing gate on the other side of the crossing. If the crossing gates are damaged, they might not warn other people travelling on the path of hazards.

SUMMARY

According to some examples, there is provided a multiple direction gate release mechanism for attachment between a gate actuator and a crossing gate. The mechanism includes opposing channel shaped brackets, which attach to the gate actuator and which also serve as a mounting structure for other components. Reference is made to the multiple direction gate release mechanism as deployed in a horizontal situation across a railroad crossing grade. A primary pivot arm assembly to which a secondary pivot arm assembly and a crossing gate are attached, pivotally mounts between vertically opposed top and bottom bearing support plates located on the inwardly facing surfaces of opposed channel shaped brackets. The primary pivot arm assembly is pivotable for the most part in a clockwise direction or to a lesser extent in a counterclockwise direction from a centered detent neutral position until limited by contacting limit stops. For example and illustration, the primary pivot arm assembly is pivotable 45° clockwise about a pivot pin and is pivotable 15° counterclockwise about the pivot pin. The primary pivot arm assembly is influenced by a detent and plunger arrangement, which maintains a combined perpendicular relationship of the primary pivot arm assembly, the secondary pivot arm assembly and the attached crossing gate with respect to the gate actuator until acted upon by outside forces. Most commonly, an outside force impinges one or more of the crossing gates when the crossing gates are deployed horizontally across both sides of a crossing grade, such as a vehicle impinging the front (approach) side of one of the crossing gates from a roadway. Such front side impingement causes the multiple direction gate release mechanism, with the attached secondary pivot arm assembly and crossing gate, to pivotally overcome the influence of the detent and plunger arrangement and to swing horizontally out of the way of the oncoming impinging vehicle. Impingement from the front side of the crossing gate from a roadway can occur without functional damage to the crossing gate. Such pivotal yielding substantially reduces the possibility of breakage of the crossing gate, as little bending moment is actually applied along the crossing gate itself due to the substantially unrestricted repositioning yielding movement allowed by the multiple direction gate release mechanism. Subsequent to such impingement and when the vehicle has ceased to contact the crossing gate, top and bottom spring assemblies function to return the primary pivot arm assembly of the multiple direction gate release mechanism with the attached secondary pivot arm assembly and crossing gate to the detent and neutral centered position to continue to offer gated protection at the railroad crossing grade, especially for those vehicles approaching from the abutting roadway. A shock absorber allows for rapid rate pivoting of the primary pivot arm assembly and attached secondary pivot arm assembly and attached crossing gate in one direction during impingement and allows for a slower rate return of the primary pivot arm assembly and attached members in the return direction subsequent to impingement. The centering spring assembly assists in returning of the primary pivot arm assembly to the detent position in the case of a return overshoot.

Additional protection of the crossing gate is afforded in the opposite direction with respect to a vehicle on the actual crossing grade, ie., a vehicle on the tracks, which approaches and impinges the back side of the crossing gate. The secondary pivot arm assembly is pivotally mounted to the primary pivot arm assembly and extends outwardly therefrom to accommodate attachment of the crossing gate to offer relief from a crossing gate back side impingement. The secondary pivot arm assembly pivots in a counterclockwise direction about a pivot pin located near the end of the primary pivot arm assembly. Top and bottom spring assemblies function to return the secondary pivot arm assembly and maintain the combined perpendicular relationship of the primary pivot arm assembly, the secondary pivot arm assembly, and the attached crossing gate with respect to the gate actuator.

One aspect of the present invention is a multiple direction gate release mechanism that is secured between the mount arms of a gate actuator and a crossing gate.

Another aspect of the present invention is a multiple direction gate release mechanism, which, when impinged, releasably allows a breakaway positioning in two directions of a crossing gate from a normal and detent position in order to prevent damage to the crossing gate.

Another aspect of the present invention is a multiple direction gate release mechanism, which allows the return positioning of a crossing gate to a normal and detent position subsequent to a breakaway positioning caused by impingement.

Still another aspect of the present invention is a multiple direction gate release mechanism, which offers grade crossing protection subsequent to crossing gate impingement.

Still another aspect of the present invention is a multiple direction gate release mechanism having a secondary pivot arm assembly pivotally attached to a primary pivot arm assembly where the secondary pivot arm assembly can operate in concert with the primary pivot arm assembly or can operate independently of the primary pivot arm assembly.

Yet another aspect of the present invention is the use of cables attached to the primary pivot arm assembly that are influenced by springs in spring assemblies, which springs are compressed during impingement with the front side of a crossing gate and that are used to subsequently power the return of the primary pivot arm assembly, attached secondary pivot arm assembly and attached crossing gate assembly to an original neutral and detent position.

A further aspect of the present invention is the use of a shock absorber, which allows rapid deployment of the primary pivot arm assembly having an attached secondary pivot assembly and attached crossing gate during frontal crossing gate impingement and which allows return of the primary pivot arm assembly having the attached secondary pivot arm assembly and crossing gate at a slower rate subsequent to impingement, whereby the slower return rate reduces the possibility of a return overshoot of the primary pivot arm assembly, attached secondary pivot arm assembly and attached crossing gate assembly.

Yet another aspect of the present invention is the use of swing stops, which limit the travel of the primary pivot arm assembly in clockwise and counterclockwise rotational movements in order to prevent overstressing or other damage to the cables used in the associated spring assemblies.

Yet another aspect of the present invention is the use of stop plates or other structure, which limit the travel of the secondary pivot arm assembly in a counterclockwise rotational movement in order to prevent overstressing or other damage to the cables used in the associated spring assemblies.

A still further aspect of the present invention is the use of a centering spring assembly, which urges the primary pivot arm assembly into a normal and detent position when a returning primary crossing gate assembly, attached secondary pivot arm assembly, and attached crossing gate assembly overshoot a neutral detent position.

Various examples provide a multiple direction gate release mechanism. Although a multiple direction gate release mechanism is described, the release mechanism can be used for other gates such as, but not limited to, parking lot gates, restricted access gates, road closure gates, toll gates, crowd control gates and the like.

DETAILED DESCRIPTION

Figure 1:
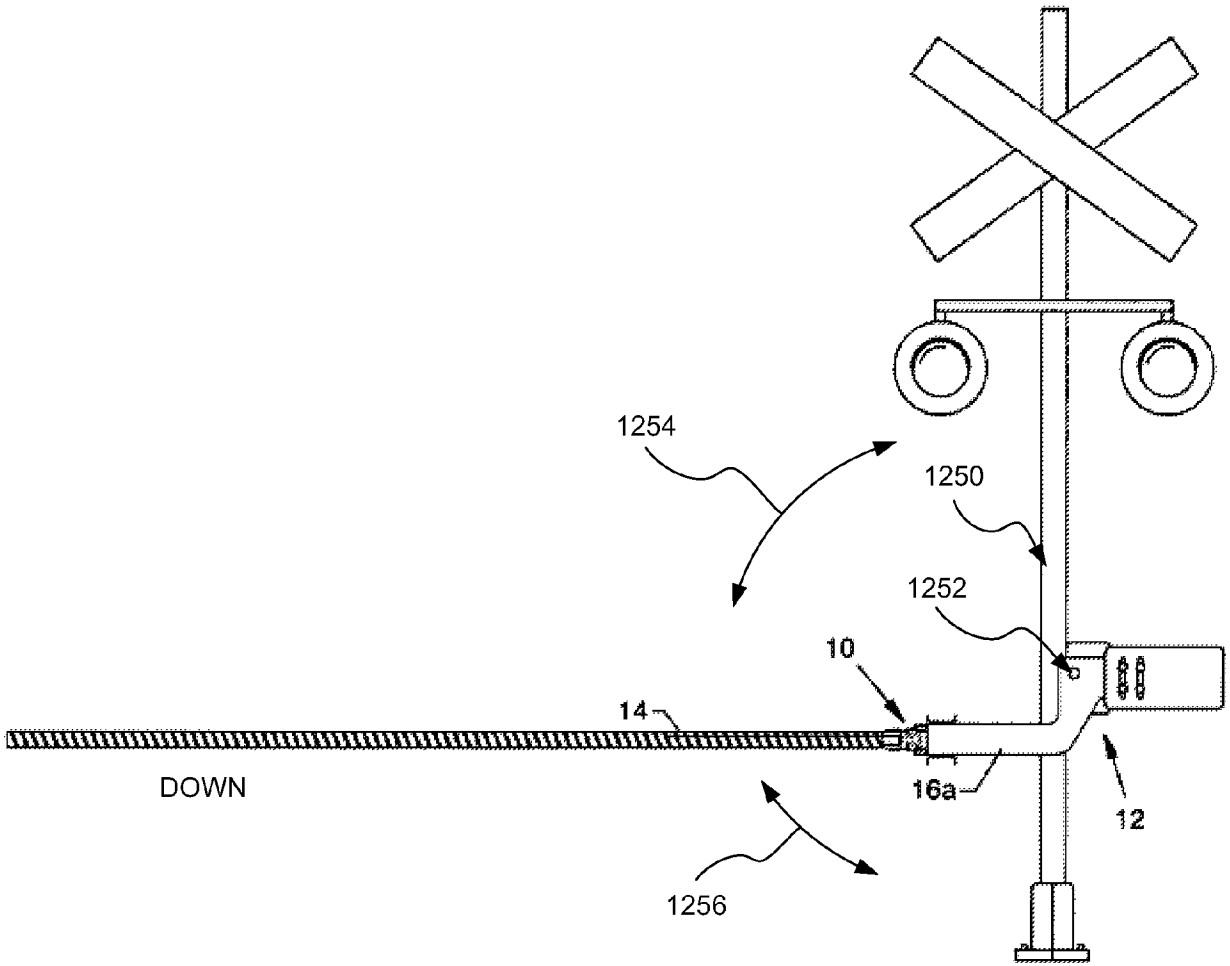
FIG. 1 illustrates the use of a multiple direction gate release mechanism, the present invention, wherein a gate actuator is shown in the actuated position to position the multiple direction gate release mechanism and the attached crossing gate in a horizontal position.

FIG. 1 shows a multiple direction gate release mechanism 10. The crossing gate or arm 14 is rotable up for storage and down in use (shown) to warn people, for example, of train crossings. The gate release mechanism 10 is a spring-loaded breakaway that permits the arm 14 to rotate into the page and out of the page when collided with, with one or more springs returning the gate to the position as shown after the collision is over.

A gate actuator 12 is shown in the actuated position to position the multiple direction gate release mechanism 10 and attached crossing gate 14 in a horizontal position. The multiple direction gate release mechanism 10 is mounted between the ends of the mount arms 16*a* and 16*b* (FIG. 2) and the crossing gate 14 is mounted to the multiple direction gate release mechanism 10.

Figure 2:
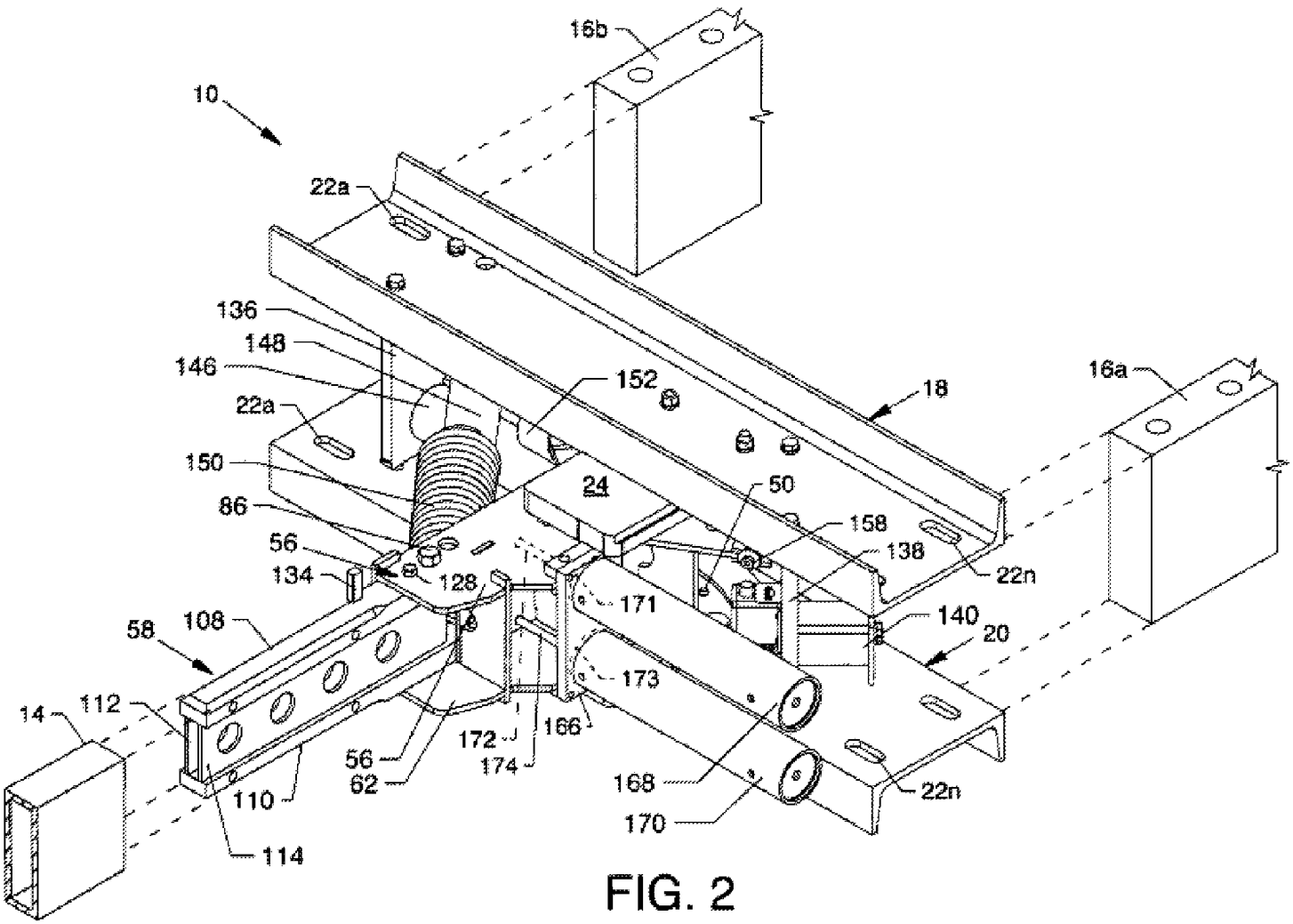
FIG. 2 is a right side isometric view of the multiple direction gate release mechanism, the present invention, along with portions of mount arms and a crossing gate that are associated therewith in use.

FIG. 2 is a right side isometric view of the multiple direction gate release mechanism 10 of the present invention showing its connecting relationship between mount arms 16*a* and 16*b* of the gate actuator 12 and the crossing gate 14. Top and bottom mounting brackets 18 and 20 in the form of channels accommodate attachment of the mount arms 16*a* and 16*b*. The crossing gate 14 is secured over and about a secondary pivot arm assembly 58 of the multiple direction gate release mechanism 10, each of which is shown in a horizontal position, such as for stopping traffic at a railroad grade crossing.

Figure 3:
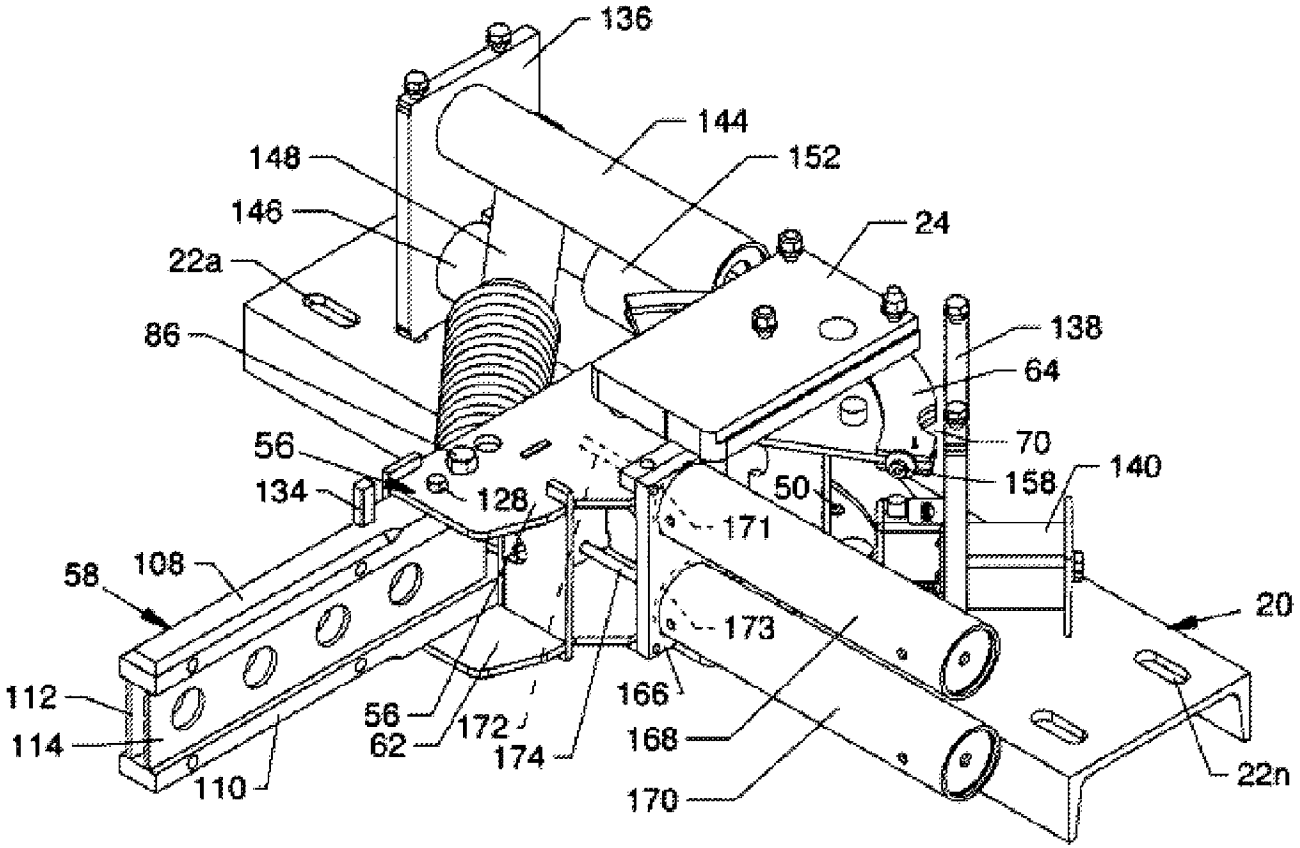
FIG. 3 is a right side isometric view of the multiple direction gate release mechanism with a top bracket removed.
Figure 4:
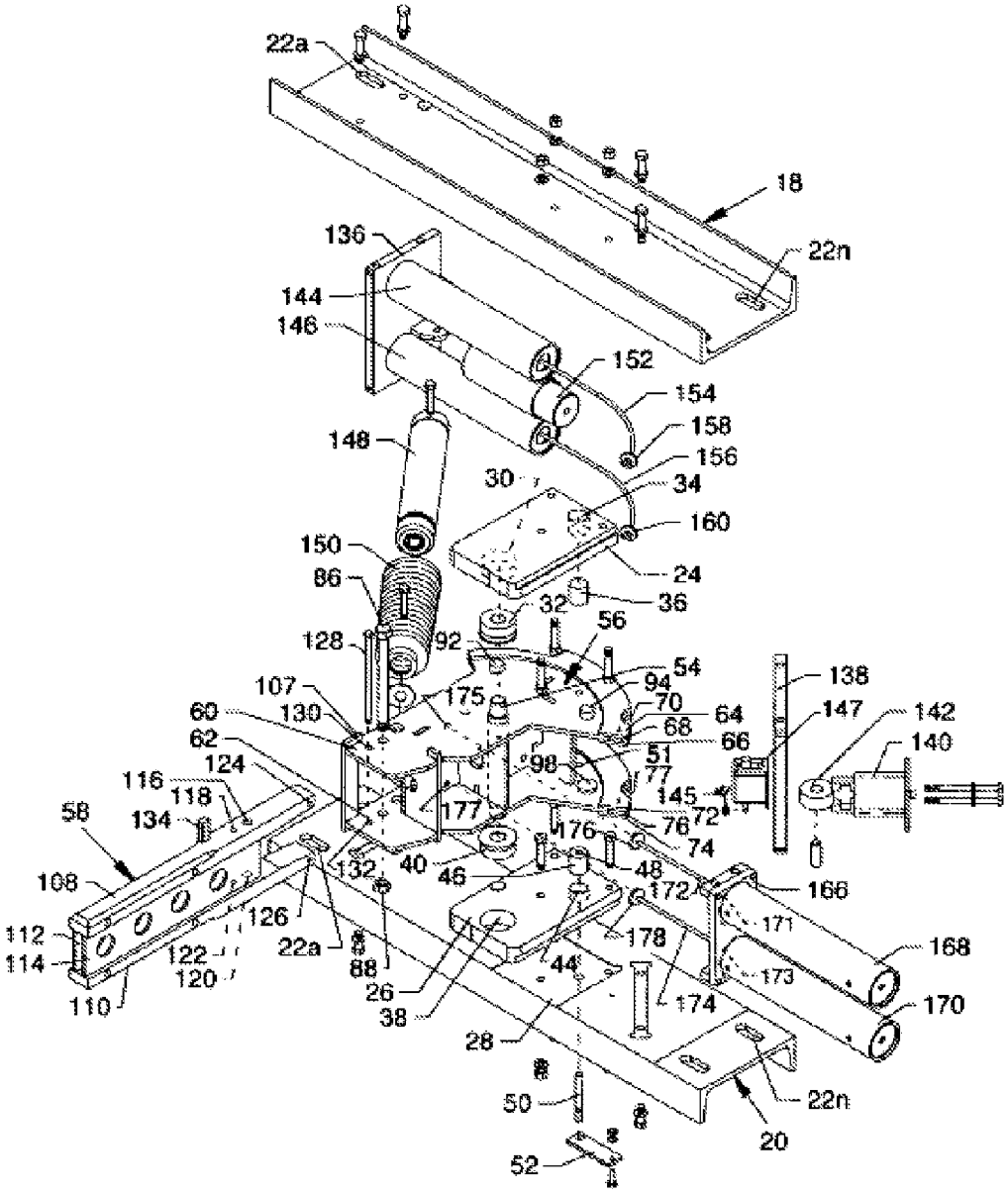
FIG. 4 is an exploded isometric view of the components of the invention shown in FIG. 2.
Figure 5:
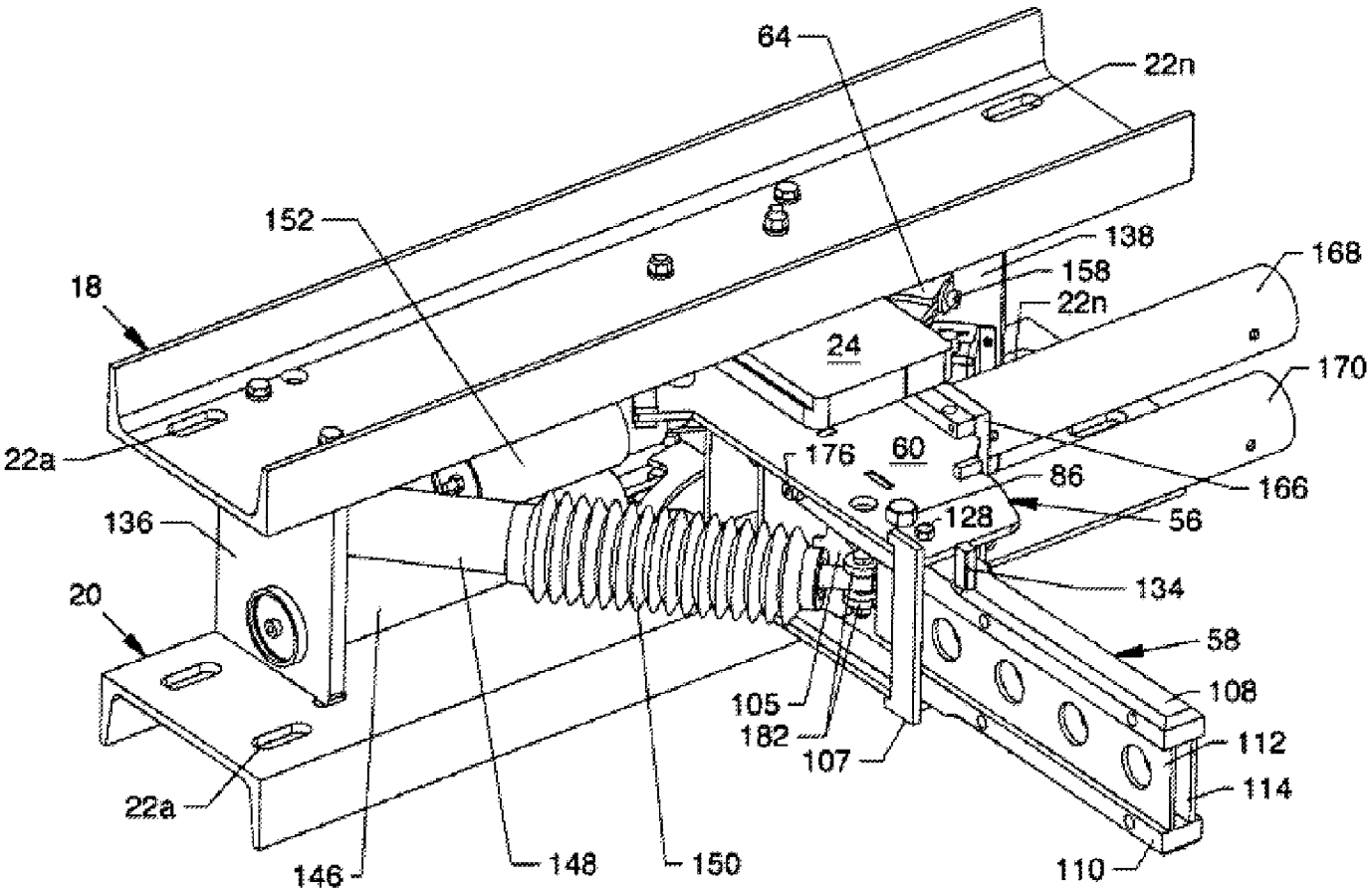
FIG. 5 is left side isometric view of the multiple direction gate release mechanism.
Figure 6:
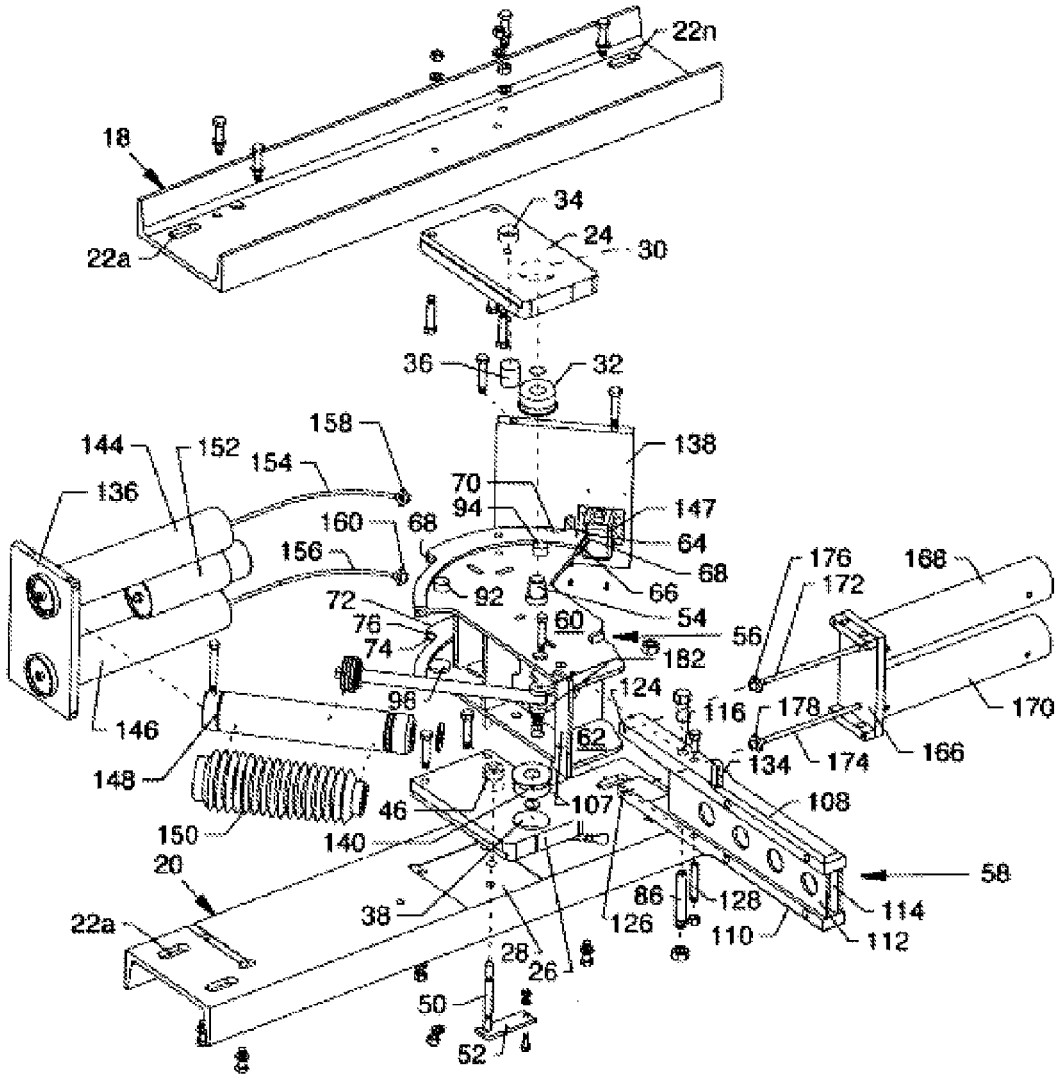
FIG. 6 is an exploded isometric view of the components of the invention shown in FIG. 5.

Multiple views of the invention are included for a full understanding of the present invention including isometric views, exploded isometric views, and isometric views of several components generally shown in a horizontal orientation as deployed across a crossing grade. FIG. 3 is a right side isometric view of the multiple direction gate release mechanism 10 with a top mounting bracket 18 (FIG. 2) removed for the purpose of clarity. FIG. 4 is an exploded isometric view of the components of the invention shown in FIG. 2. FIG. 5 is a left side isometric view of the multiple direction gate release mechanism. FIG. 6 is an exploded isometric view of the components of the invention shown in FIG. 5. With respect to the above figures, the invention is further described. In the invention, a plurality of nuts, bolts, and lock washers are secured through a plurality of holes in a plurality of diverse components as is common practice in the art and as are shown or indicated in engagement or alignment wherever practicable or suitable in the accompanying illustrated figures.

Partial or fully visible components of the multiple direction gate release mechanism 10 include opposing top and bottom mounting brackets 18 and 20 in the form of a channel, each having a plurality of mounting holes 22*a*-22*n* used in the attachment of mount arms 16*a* and 16*b* of the gate actuator 12, as well as other holes and features for mounting other components thereto. Opposed top and bottom bearing support plates 24 and 26 are preferably aligned with recessed surfaces on the inwardly facing surfaces of the top and bottom mounting brackets 18 and 20 are suitably secured thereto; one such recessed surface 28 is shown in FIG. 4. The top bearing support plate 24 includes a circular recess 30 opening downwardly for the fixed accommodation of a top bearing assembly 32. The top bearing support plate 24 also includes a hole 34 for the fixed accommodation of a stop pin 36 having of a greater vertical dimension than the thickness dimension of the top bearing support plate 24. The bottom portion of such a top stop pin 36 extends downwardly a short distance beyond the bottom surface of the top bearing support plate 24. Also, the bottom bearing support plate 26 includes a circular recess 38 opening upwardly for the fixed accommodation of a bottom bearing assembly 40. The bottom bearing support plate 26 also includes a hole 44 for the protected accommodation of a bottom stop pin 46 having of a greater vertical dimension than the thickness dimension of the bottom bearing support plate 26. The top portion of such a bottom stop pin 46 extends upwardly a short distance beyond the top surface of the bottom bearing support plate 26. The bottom stop pin 46 includes a vertically aligned central bore 48, thus enabling the accommodation of a replaceable protective shear pin 50, the latter of which extends vertically and upwardly through the bottom mounting bracket 20. The protective shear pin 50 extends further to align coaxially and indirectly through the hole 44 and coaxially and directly into the central bore 48 of the bottom stop pin 46. The top portion of the replaceable shear pin 50 extends upwardly beyond the top surface of the bottom stop pin 46 to engage a hole 51 in a bottom swing plate 62. The replaceable shear pin 50 is secured to the bottom of the bottom mounting plate 20 by means of a moveable retainer plate 52. A connection between the top bearing support plate 24 and the bottom bearing support plate 26 is provided by a vertically oriented pivot pin 54 extending therebetween. Opposed ends of the vertically oriented pivot pin 54 are aligned within and extend between the top bearing assembly 32 and the bottom bearing assembly 40 and functions as support for a primary pivot arm assembly 56 described later in detail. A secondary pivot arm assembly 58 is pivotally supported by and extends outwardly from the primary pivot arm assembly 56. The pivot pin 54 extends through and is secured to the structure of the primary pivot arm assembly 56.

Figure 7:
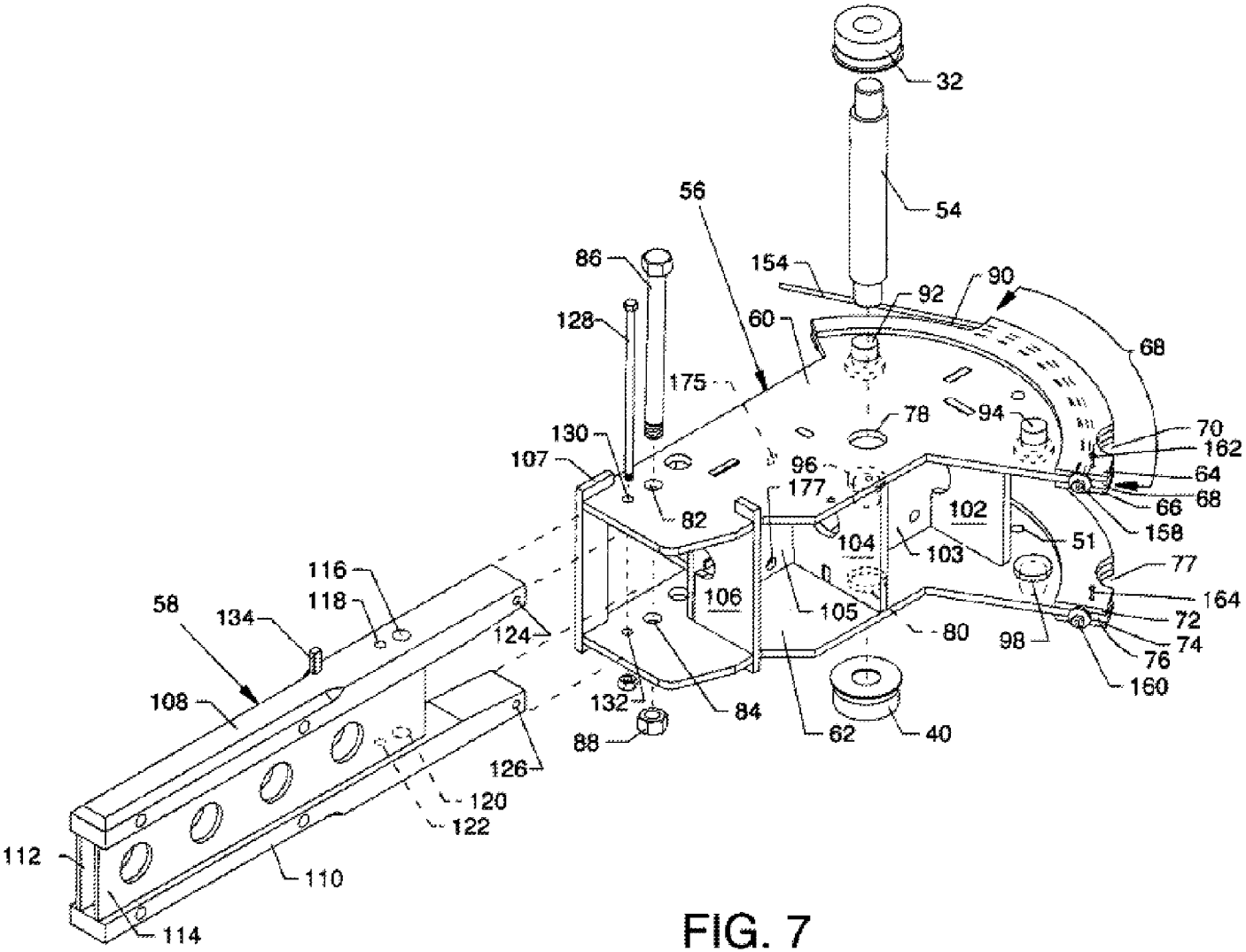
FIG. 7 is an isometric view of the primary and secondary arm assemblies and other closely associated components.

The primary pivot arm assembly 56 is aligned between the top and bottom bearing support plates 24 and 26, respectively, and is mounted and pivotally secured therebetween by the pivot pin 54 that is in close intimate contact with the top bearing assembly 32 and the bottom bearing assembly 40. The primary pivot arm assembly 56 includes, in part, opposing geometrically configured and vertically spaced top and a bottom swing plates 60 and 62. As viewed in FIG. 7, one end of the top swing plate 60 is arcuate in shape and accommodates the secured mounting of opposed arcuate top and bottom cable guide plates 64 and 66. The top and bottom cable guide plates 64 and 66 extend beyond the edge of the arcuate end of the top swing plate 60 to form an arcuate cable channel 68 therebetween. A semicircular detent 70 is formed by semicircular cutouts in each of the top and bottom cable guide plates 64 and 66, the combination of which forms the detent 70. The bottom swing plate 62 is made substantially similar to the top swing plate 60 and includes opposing arcuate top and bottom cable guide plates 72 and 74 to form an arcuate cable channel 76. A semicircular detent 77 is formed by semicircular cutouts in each of the top and bottom cable guide plates 72 and 74, the combination of which forms the detent 77. It is noted that the cable channel 68 and the cable channel 76 are abbreviated with respect to the full arcuate length of the top cable guide plate 64, the bottom cable guide plate 66, the top cable guide plate 72, and the bottom cable guide plate 74, respectively, in order to allow room for accommodation of spring assembly structures described later in detail. Such abbreviation is provided by reducing the width, i.e, a reduction of the radius of the top cable guide plate 64, the bottom cable guide plate 66, the top cable guide plate 72 and the bottom cable guide plate 74, such as representatively shown at reference 90 at the top cable guide plate 64. A hole 78 (FIG. 7) is included at the pivot axis of the primary pivot arm assembly 56 in the top swing plate 60 in opposed alignment with a hole 80 in the bottom swing plate 62 for accommodating of the opposed ends of the pivot pin 54. The body of the pivot pin 54 is suitably secured in the holes 78 and 80 such as by weldments. The ends of the pivot pin 54 extend beyond the top and bottom surfaces of the top swing plate 60 and the bottom swing plate 62 in order to fittingly accommodate the top bearing assembly 32 and the bottom bearing assembly 40, respectively. Another set of opposed holes is located at one end of the primary pivot arm assembly 56 including a hole 82 in the top swing plate 60 in opposed alignment with a hole 84 in the bottom swing plate 62 for accommodation of a pivot pin 86 in the form of a bolt that is secured therein by a nut 88. The pivot pin 86 is used to pivotally secure the secondary pivot arm assembly 58 to the primary pivot arm assembly 56 using holes 82 and 84 and pivot holes 116 and 120, each of which is shown in FIG. 7. Swing stops 92 and 94 are mounted in the top swing plate 60 and swing stops 96 and 98 are mounted in the bottom swing plate 62 in order to limit rotation of the primary pivot arm assembly 56 at clockwise and counterclockwise limits, as described below. Each swing stop is shouldered and protrudes through holes in the respective top or bottom swing plate 60 and 62. The swing stops 92 and 94 protrude upwardly through and slightly beyond the top surface of the top swing plate 60 in order to impinge the top stop pin 36 mounted in and extending downwardly from the top bearing support plate 24. The swing stops 96 and 98 protrude downwardly through and slightly beyond the bottom surface of the bottom swing plate 62 in order to impinge the bottom stop pin 46 extending from the bottom bearing support plate 26. Swing stops 92 and 96 provide a clockwise rotation stop at approximately 45° from center, for example, and the swing stops 94 and 98 provide a counterclockwise rotation stop at approximately 15° from center, for example and illustration. Vertically aligned tabbed brace plates 102, 103, 104, 105 and 106 are aligned and secured between the top swing plate 60 and the bottom swing plate 62, thereby connecting the top swing plate 60 and the bottom swing plate 62. A vertically oriented support plate 107 connects one edge of the top swing plate 60 to a corresponding edge of the bottom swing plate 62. The secondary pivot arm assembly 58 includes opposed horizontally aligned top and bottom bars 108 and 110, respectively. Opposed vertically aligned and spaced plates 112 and 114 are aligned and secured between the top and bottom bars 108 and 110. The top bar 108 includes a vertically aligned pivot hole 116 and a juxtaposed vertically aligned hole 118, each extending through the top bar 108. Correspondingly, the bottom bar 110 includes a vertically aligned pivot hole 120 and a juxtaposed vertically aligned hole 122, each extending through the bottom bar 110 in alignment with the pivot hole 116 and the hole 118 of the top bar 108. The inboard ends of the top bar 108 and the bottom bar 110 are aligned between the outboard ends of the top swing plate 60 and the bottom swing plate 62 and are pivotally connected to the pivot pin 86. The pivot pin 86 extends through holes 82 and 84 of the top swing plate 60 and the bottom swing plate 62 and through the holes 116 and 120 of the top and bottom bars 108 and 110, respectively. Horizontally aligned cable adapter holes 124 and 126 extend through the inboard ends of the top and bottom bars 108 and 110, respectively. A replaceable shear pin 128, which generally prevents pivoting of the secondary pivot arm assembly 58 with respect to the primary pivot arm assembly 56, is installed in holes 130 and 132, respectively, at the end of the top swing plate 60 and the bottom swing plate 62 and through holes 118 and 122 in the top and bottom bars 108 and 110. A stop bar 134 is located on the top bar 108 of the secondary pivot arm assembly 58 that is used to align the inboard end of the crossing gate 14 along the secondary pivot arm assembly 58.

Having described the structure of a plurality of components comprising the primary pivot arm assembly 56 and the secondary pivot arm assembly 58, and parts and components closely associated therewith thereto, other components and associated structure, which influence the static and the actuated states before, during, and after impingement of a crossing gate 14 by an outside force either to the front or to the rear of a crossing gate 14, are now described referring primarily to FIGS. 3, 4, 5 and 6. A vertically aligned left brace plate 136 and right brace plate 138 are mounted vertically between the top mounting bracket 18 and the bottom mounting bracket 20 such that the left brace plate 136 and right brace plate 138 serve as mounts for other components, as well as assisting in structural support for various previously described components.

Certain components are useful in maintaining position of as well as protecting and returning a displaced crossing gate 14 to a centered neutral position following the impingement on the front of the crossing gate 14 by an outside force. A plunger housing 140, including a spring loaded movable round end plunger 142, is mounted on the right brace plate 138. The round end plunger 142 extends through an opening in the right brace plate 138 in order to engage the detent 77 in the bottom swing plate 62 of the primary pivot arm assembly 56 and to maintain the position of the primary pivot arm assembly 56 in a static and centered neutral position, whereby the crossing gate 14 is maintained in an extended horizontal position across a grade crossing. Upon a forcible impingement on the front side of the crossing gate 14, the primary pivot arm assembly 56 is forced to rotate about the pivot pin 54 and simultaneously the top of the shear pin 50 is sheared whereby such movement drives the round end plunger 142 from the detent 77. Subsequent to disengagement of the round end plunger 142 from the detent 77, other forces, as provided by the operation of other components of the invention, serve to return the primary pivot arm assembly 56 to a static and centered neutral position, whereby the round end plunger 142 forcibly re-engages the detent 77. A collection of return components is associated directly or indirectly with the left brace plate 136 including pivotally mounted top and bottom spring assemblies 144 and 146, a shock absorber 148 having a cover 150 pivotally secured to the left brace plate 136 and a centering spring assembly 152 secured between the free ends of the top and bottom spring assemblies 144 and 146. Cables 154 and 156 extend from the top and bottom spring assemblies 144 and 146 to engage the length of the cable channels 68 and 76, respectively. Cable ball and washer assemblies 158 and 160 are affixed to the ends of the cables 154 and 156, respectively, and are aligned at one end of the cable channels 68 and 76, respectively. The ends of the cables 154 and 156 are positionally secured in the cable channels 68 and 76 by pins 162 and 164 (FIG. 7) extending through the top cable guide plate 64 and the bottom cable guide plate 66 and extending through the top cable guide plate 72 and the bottom cable guide plate 74, respectively, at a position outboard of and in close proximity to the cables 154 and 156. A connector assembly 145 connects between the round end plunger 142 support structure and an event counter 147 that is attached to the inside surface of the right brace plate 138.

Certain components are useful in protecting and returning a displaced crossing gate 14 to a centered neutral position with respect to impingement of the rear of the crossing gate 14 by an outside force. A vertically aligned bracket assembly 166 is secured to the edges of the top swing plate 60 and the bottom swing plate 62 of the primary pivot arm assembly 56 as a mount for a top and bottom spring assemblies 168 and 170. The top and bottom spring assemblies 168 and 170 are suitably secured in annular grooves 171 and 173 in the bracket assembly 166. The ends of cables 172 and 174 (FIG. 4) extend from the top and bottom spring assemblies 168 and 170 through body holes 175 and 177 in the tabbed brace plate 105 (FIG. 7) and engage the cable connection holes 124 and 126 at the inboard ends of the top bar 108 and the bottom bar 110 of the secondary pivot arm assembly 58, respectively. Cable ball and washer assemblies 176 and 178 are affixed to the ends of cables 172 and 174, respectively, in order to retain the ends of the cables 172 and 174 within the cable connection holes 124 and 126, respectively.

Figure 8:
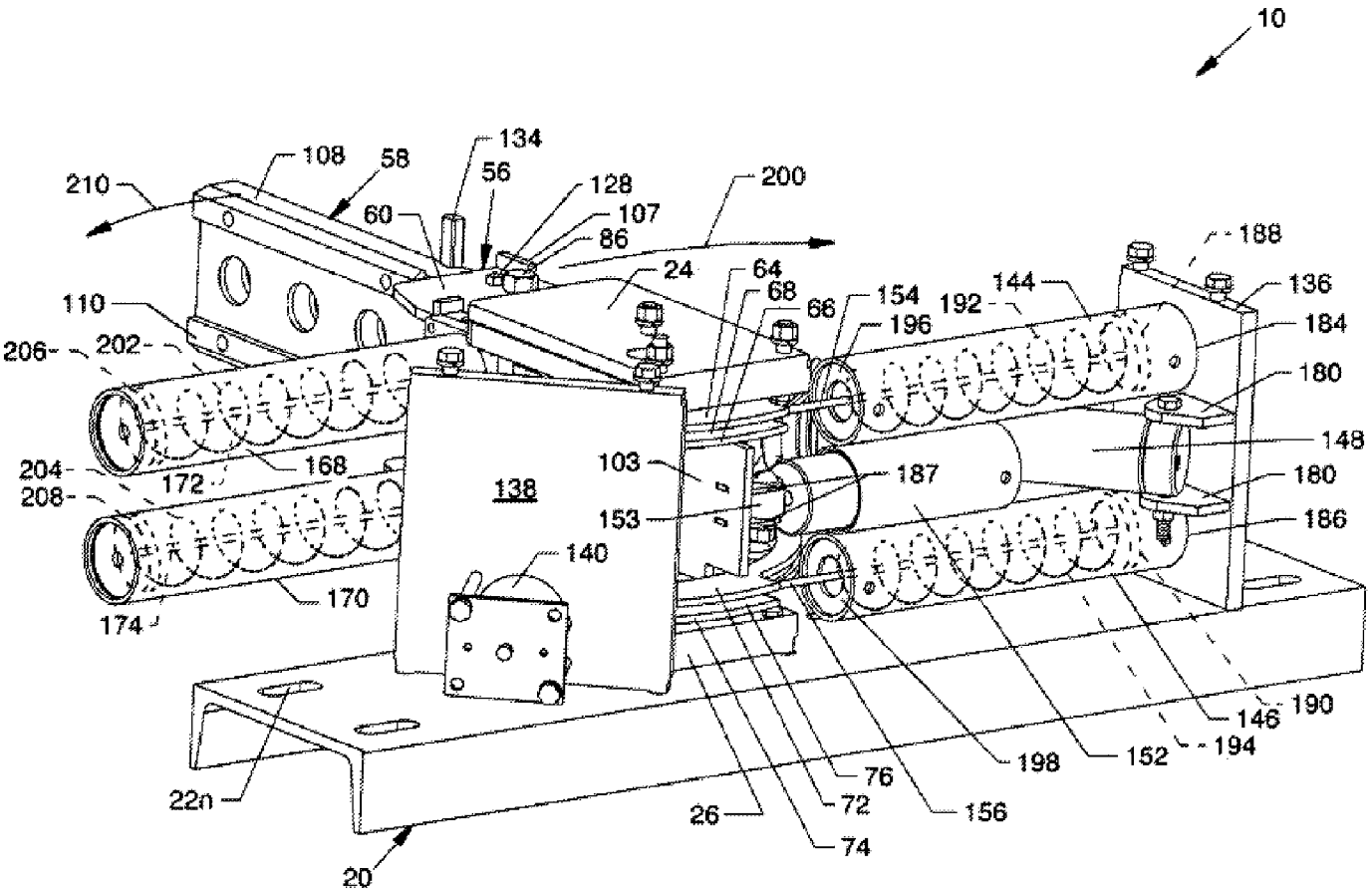
FIG. 8 is a rear isometric view of the multiple direction gate release mechanism.

FIG. 8 is a rear isometric view of the elements shown in FIG. 3. Illustrated, in particular, is the relationship of the primary pivot arm assembly 56 with respect to the top and bottom spring assemblies 144 and 146, the centering spring assembly 152, and the shock absorber 148. Similar spaced mounting brackets 180 are secured to the left brace plate 136. One end of the shock absorber 148 is pivotally secured to the mounting brackets 180 and the other end of the shock absorber 148 is pivotally secured to spaced mounting brackets 182 on the rear of the tabbed brace plate 105 of the primary pivot arm assembly 56, both as shown in FIG. 5. The shock absorber 148 when moved to a compressed position allows for the rapid rotational movement of the primary pivot arm assembly 56 from and beyond the neutral detent position during impingement of the front side of the crossing gate 14 (FIG. 2). The shock absorber 148 allows for a slower rate of movement when returning to the centered neutral position to suitably control the return rate of the primary pivot arm assembly 56 subsequent to impingement of the front side of the crossing gate 14. The body of the centering spring assembly 152 is secured, as previously described, between the outboard ends of the top and bottom spring assemblies 144 and 146. The free end of the centering spring assembly 152 closely juxtaposes a roller 153 mounted to the tabbed brace plate 103 by the use of spaced mounting brackets 187. The centering spring assembly 152 is used to urge and assist the primary pivot arm assembly 56 to return to a normal and detent position if a return over shoot occurs, as described later in detail. The horizontally oriented top and bottom spring assemblies 144 and 146 are aligned and suitably secured in bores 184 and 186 in the left brace plate 136. One end of cables 154 and 156 is secured by cable ball and washer assemblies 158 and 160 (FIG. 4), as previously described. The cables 154 and 156 are aligned in the cable channels 68 and 76 of the top and bottom swing plates 60 and 62, respectively. The other ends of the cables 154 and 156 are secured to circular plates 188 and 190 located inside of the top and bottom spring assemblies 144 and 146. Springs 192 and 194 are located interior to the top and bottom spring assemblies 144 and 146 between the circular plates 188 and 190 and the inward facing ends 196 and 198 of the top and bottom spring assemblies 144 and 146. Clockwise pivotal movement of the primary pivot arm assembly 56 about the pivot pin 54 also carries the attached secondary pivot arm assembly 58 in a clockwise direction as indicated by arrow 200 in a unitary clockwise movement. Such pivotal movement causes compression of the springs 192 and 194 to provide a built-up energy for subsequent spring powered action of the primary pivot arm assembly 56 (and the attached non-pivoted secondary pivot arm assembly 58) to return the primary pivot arm assembly S6 to its normal centered neutral detent position subsequent to frontal impingement of the crossing gate 14.

As partially shown in FIG. 8 and with understood reference to previously described figures, the relationship of the secondary pivot arm assembly 58 to the top and bottom spring assemblies 168 and 170 is now described. Springs 202 and 204 are located interior to the top and bottom spring assemblies 168 and 170 and are attached to and located between each of the circular plates 206 and 208 and the inward facing ends (not shown) of the top and bottom spring assemblies 168 and 170. Pivotal movement of the secondary pivot arm assembly 58 in a counterclockwise direction about the pivot pin 86 as indicated by arrow 210 is caused by impingement to the rear of the crossing gate 14 resulting in shearing of the shear pin 128 and in compression of the springs 202 and 204 through the cables 172 and 174. Such pivotal movement provides built-up energy for subsequent spring powered action by the top and bottom spring assemblies 168 and 170 to cause the secondary pivot arm assembly 58 to return to its normal position against the tabbed brace plate 105 subsequent to rearward impingement of the crossing gate 14.

Figure 9:
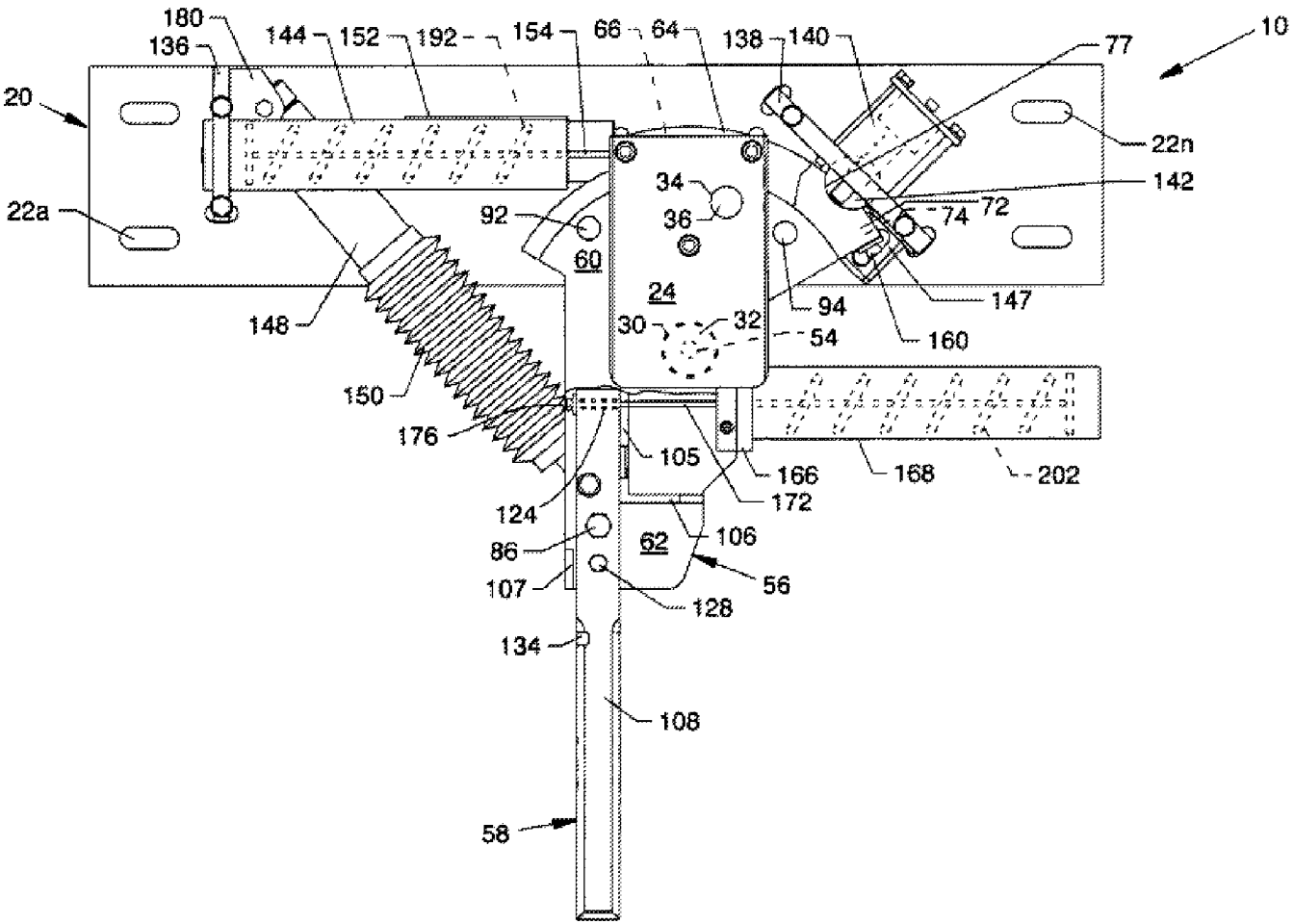
FIG. 9 is a top view of the multiple direction gate release mechanism in partial cutaway showing its normal detent position when in use to deploy an attached crossing gate attached thereto.

FIG. 9 is a top view of the multiple direction gate release mechanism 10 in partial cutaway showing its normal detent centered neutral position when in use to deploy in attached crossing gate 14 (not shown) across a railroad grade crossing. The top cable guide plate 64 and underlying bottom cable guide plate 66 are shown in partial cutaway to reveal the detent 77 of the primary pivot arm assembly 56. The portion of the top swing plate 60 located outboard of the tabbed brace plate 104 is cutaway in order to reveal and/or demonstrate the connection of the cable 172 (and the cable 174, not shown) to the inboard ends of the top bar 108 and the bottom bar 110 (not shown) of the secondary pivot arm assembly 58. The spring loaded round end plunger 142 forcibly and intimately engages the detent 77 of the primary pivot arm assembly 56 to maintain the neutral position of the primary pivot arm assembly 56 when the crossing gate 12 (FIG. 2) is extended across a railroad crossing grade. The spring loaded round end plunger 142 has a sufficient outwardly directed force to maintain the primary pivot arm assembly 56 including the secondary pivot arm assembly 58 and the attached crossing gate 14 in the desired centered neutral detent orientation in either a raised or lowered position or positions therebetween to maintain the desired proper orientation extending across the crossing grade unless impinged from either side by a vehicle or other outside force.

Mode of Operation

Figure 10:
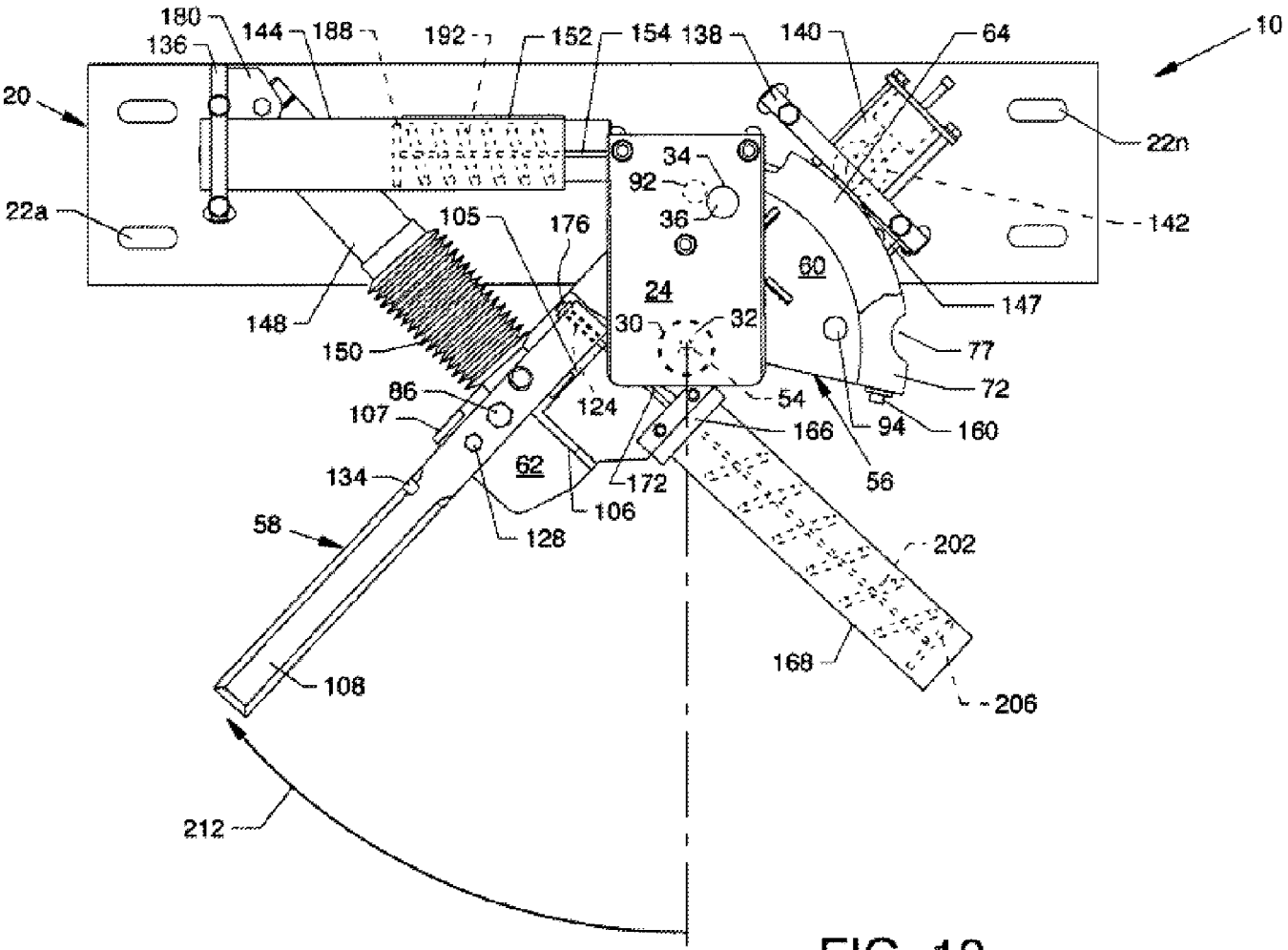
FIG. 10 is a top view of the multiple direction gate release mechanism in partial cutaway illustrating the mode of operation of the multiple direction gate release mechanism when an attached crossing gate is forcibly impinged from the front side.

FIG. 10 is a top view of the multiple direction gate release mechanism 10 in partial cutaway, as described in FIG. 9, and best illustrates the mode of operation of the multiple direction gate release mechanism 10 when an attached crossing gate 14 (not shown) is forcibly impinged from the front side. Impingement of the front side of the attached crossing gate 14 by a vehicle or other object forces causes pivoting of the primary pivot arm assembly 56 in a clockwise direction, as viewed from the top, about the pivot pin 54 as shown by arrow 212. Such forced pivoting causes a shearing of the top of the shear pin 50 and also causes forced disengagement of the spring loaded round end plunger 142 from the detent 77, whereby the round end plunger 142 tangentially and slidingly contacts the major portion of the outer edge of the arcuate top and bottom cable guide plates 72 and 74, respectively, of the primary pivot arm assembly 56, thus allowing the primary pivot arm assembly 56 and attached secondary pivot arm assembly 58 to pivot unitarily, thereby preserving the integrity of the attached crossing gate 14. During such forced unitary pivoting about the pivot pin 54, the angular relationship of the primary pivot arm assembly 56 and attached secondary pivot arm assembly 58 is unchanged with respect to each other. Clockwise pivoting of the primary pivot arm assembly 56 and attached secondary pivot arm assembly 58 is allowed at a suitable and rapid rate and is not significantly influenced by the shock absorber 148 in order that the crossing gate 14 can be rapidly deployed without breakage. However, return of the primary pivot arm assembly 56 and attached secondary pivot arm assembly 58 to the centered neutral detent position is influenced by the shock absorber 148, which acts to allow counterclockwise return pivoting at a rate much less than that during impingement caused by the clockwise pivoting. During frontal impingement caused by the clockwise pivoting of the primary pivot arm assembly 56 and attached secondary pivot arm assembly 58, the spring 192 in the top spring assembly 144 and the spring 194 in the bottom spring assembly 146 (FIG. 8) are compressed by the movement of the cables 154 and 156, respectively, one end of which resides in and is secured in the cable channels 68 and 76 located at the ends of the top swing plate 60 and the bottom swing plate 62, respectively. Such spring compression provides a force to subsequently return the primary pivot arm assembly 56 and attached secondary pivot arm assembly 58 toward and into the centered neutral detent position at a controlled rate as provided by the shock absorber 148, as previously described. Clockwise rotation is limited by impingement of the swing stop 92 of the top swing plate 60 with the top stop pin 36 of the top bearing support plate 24 as shown and by a similar impingement of the swing stop 96 of the bottom swing plate 62 with the bottom stop pin 46 of the bottom bearing support plate 26 (FIG. 4). For purposes of example and demonstration, such clockwise rotation is provided at 45° but shall not be considered to be limiting to the scope of the invention. Such limitation prevents overstressing or breakage of the top and bottom cables 154 and 156 and associated components. In the case of an unintended counterclockwise return overshoot of the detent 77 beyond the spring loaded round end plunger 142, counterclockwise motion is limited to 15° (for purposes of example and demonstration) by impingement of the swing stop 94 of the top swing plate 60 with the top stop pin 36 of the top bearing support plate 24 and by like impingement of the swing stop 98 of the bottom swing plate 62 with the bottom stop pin 46 of the bottom bearing support plate 26 (FIG. 4) to prevent overstressing or breakage of the top and bottom cables 172 and 174. In addition the centering spring assembly 152 can contact the roller 153 to urge and assist the primary pivot arm assembly 56 to return to a normal and centered neutral detent position in the event of a return overshoot, preferably prior to stopping at 15°. Such counterclockwise overshoot protection features ensure that the round end plunger 142 will maintain contact with the minor portion of the outer edge of the arcuate top and bottom cable guide plates 72 and 74, respectively, of the primary pivot arm assembly 56. The counterclockwise overshoot protection prevents the round end plunger 142 from disassociating with the minor portion of the outer edge of the arcuate top and bottom cable guide plates 72 and 74 and extending, for example, into the region of the cable ball and washer assembly 160, whereby an overly directed round end plunger 142 could lock the primary pivot arm assembly 56 and attached secondary pivot arm assembly 58 in a position to one side of the neutral detent position. For purposes of example and demonstration such counterclockwise rotation is provided at a 15° angle but shall not be considered limiting to the scope of the invention.

Figure 11:
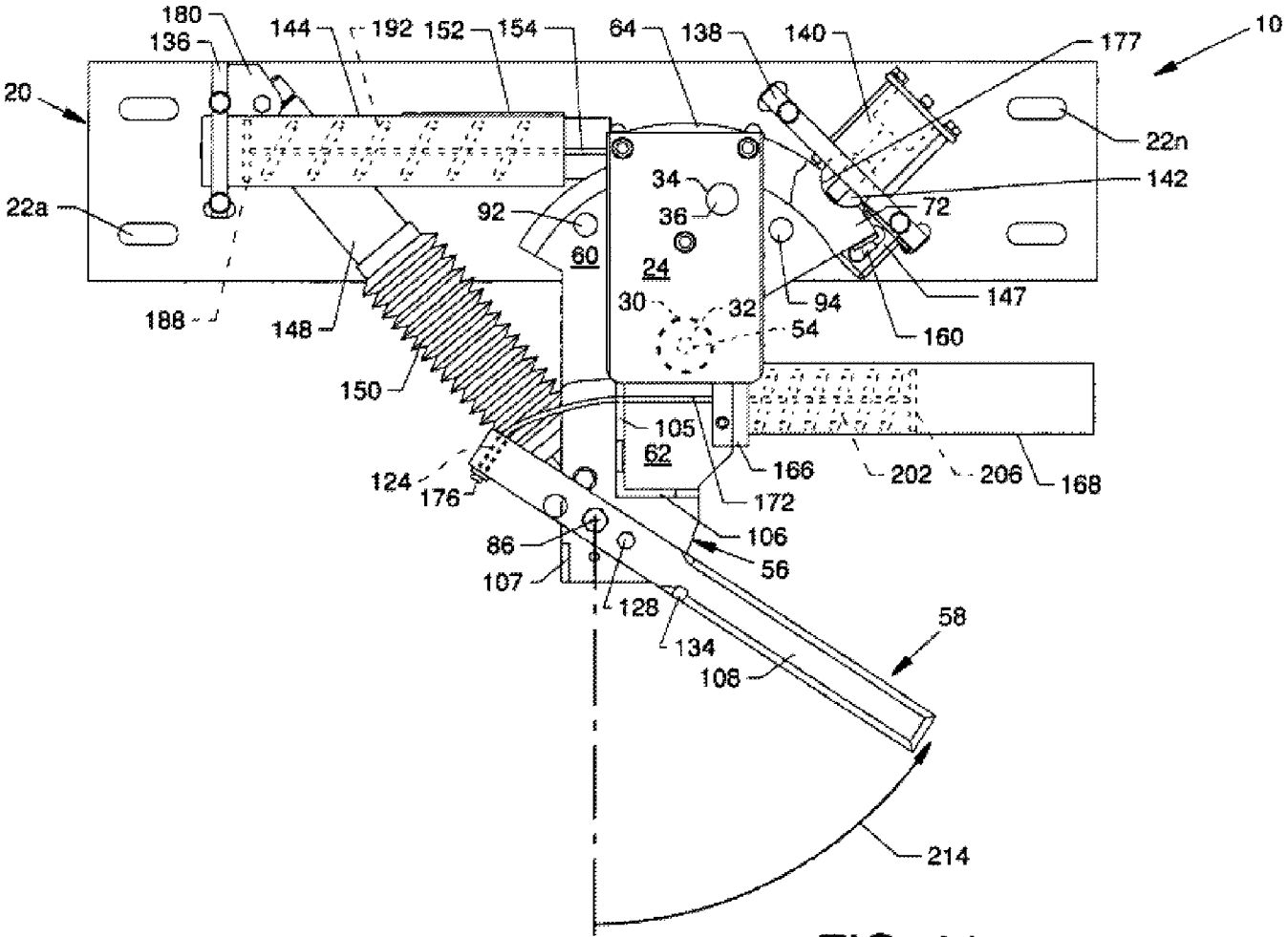
FIG. 11 is a top view of the multiple direction gate release mechanism in partial cutaway and best illustrates the mode of operation of the multiple direction gate release mechanism when an attached crossing gate is forcibly impinged from the back side.

FIG. 11 is a top view of the multiple direction gate release mechanism 10 in partial cutaway, as described in FIG. 9, and best illustrates the mode of operation of the multiple direction gate release mechanism 10 when an attached crossing gate 14 (now shown) is forcibly impinged from the back side. Impingement of the back side of the attached crossing gate 12 (FIG. 1) by a vehicle or other substantial object causes shearing of the shear pin 128 and pivoting of the secondary pivot arm assembly 58 in a counterclockwise direction, as viewed from the top, about the pivot pin 86 as shown by arrow 214. During rearward impingement causing counterclockwise pivoting of the secondary pivot arm assembly 58, the spring 202 in the top spring assembly 168 and the spring 204 in the bottom spring assembly 170 (not shown) are compressed by the movement of the cables 172 and 174, respectively. Such a spring compression provides a force to subsequently return the secondary pivot arm assembly 58 in a clockwise rotation to intimately contact the tabbed brace plate 105 that is the normal position with respect to the primary pivot arm assembly 56. Counterclockwise rotation is limited by impingement of the top and bottom bars 108 and 110 with the tabbed brace plate 106, which functions as a stop to prevent overstressing or breakage of the top and bottom cables 172 and 174. Additionally, protection is provided in an articulating fashion. If the secondary pivot arm assembly 58 is positioned to invoke stoppage by the tabbed brace plate 106 and further positioned in a counterclockwise manner, additional protection is provided by counterclockwise rotation of the primary pivot arm assembly 56 until limitation by impingement of the swing stop 94 of the top swing plate 60 with the top stop pin 36 of the top bearing support plate 24 and by like impingement of the swing stop 98 of the bottom swing plate 62 with the bottom stop pin 46 of the bottom bearing support plate 26. Thus, pivotal arm relief is provided for either the front side or rear side impingement of the attached crossing gate 14. Shearing of the shear pin in a front impingement of the crossing gate 14 or shearing of the shear pin 128 is an indication to maintenance personnel that the crossing gate 14 has been impacted from the front or rear respectively. Crossing gate protection and function is in effect with the shear pins 50 or 128 in a sheared or un-sheared state.

Figure 12:
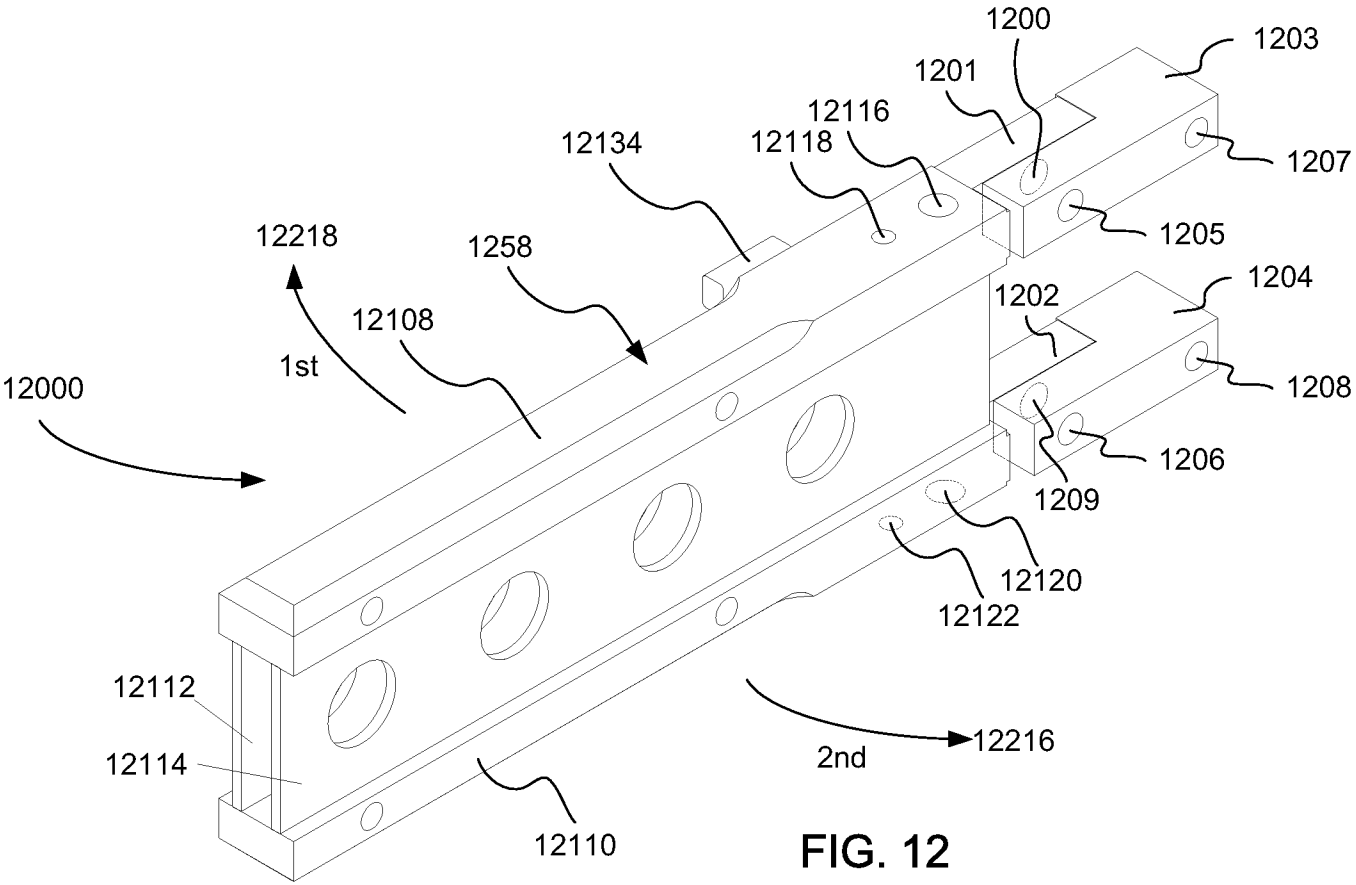
FIG. 12 is a perspective view of system for servicing a crossing gate, according to some embodiments.

FIG. 12 is a perspective view of system 12000 for servicing a crossing gate, according to some embodiments. The system 12000 is part of a system coupled to a crossing gate mount, such as the mount 1250 in FIG. 1. In some examples, a crossing gate actuator 12 (FIG. 1) is coupled to a pivot such as the vertical swing pivot 1252 in FIG. 1, which is coupled to the crossing gate mount 1250. In some examples, the crossing gate actuator 12 is rotable up 1254 and out of a path and down 1256 and into the path. A path includes an automobile road that crosses a railroad grade, for example.

In some examples, opposed and vertically aligned and spaced plates 12112 and 12114 are aligned and secured between the top and bottom bars 12108 and 12110. The top bar 12108, in certain examples, includes a vertically aligned pivot hole 12116 and a juxtaposed vertically aligned hole 12118, each extending through the top bar 12108. In some instances, the bottom bar 12110 includes a vertically aligned pivot hole 12120 and a juxtaposed vertically aligned hole 12122, each extending through the bottom bar 12110 in alignment with the pivot hole 12116 and the hole 12118 of the top bar 12108.

In some examples, the inboard ends of the top bar 12108 and the bottom bar 12110 are aligned between the outboard ends of the top swing plate 60 and the bottom swing plate 62 and are pivotally connected to the pivot pin 86. In some examples, the pivot pin 86 extends through holes 82 and 84 of the top swing plate 60 and the bottom swing plate 62 and through the holes 12116 and 12120 of the top and bottom bars 12108 and 12110, respectively.

In various examples, horizontally aligned cable adapter holes 1207 and 1208 extend through arm bar segments 1203 and 1204, respectively. The arm bar segment have pilot holes 1205 and 1206 respectively opening to holes 1200 and 1209 in respective inboard ends 1201 and 1202 of the top and bottom bars 12108 and 12110. In various examples, a replaceable shear pin 128 that generally resists pivoting of the secondary pivot arm assembly 1258 with respect to the primary pivot arm assembly 56 is installed in holes 130 and 132, respectively, at the end of the top swing plate 60 and the bottom swing plate 62 and through holes 12118 and 12122 in the top and bottom bars 12108 and 12110. In various examples, a stop bar 12134 is located on the top bar 12108 of the secondary pivot arm assembly 1258.

A crossing gate release mechanism, e.g., 10 in FIG. 1, is coupled to the crossing gate actuator 12 (FIG. 1). In various embodiments, a crossing gate, such as crossing gate 14, is coupled to one or more a horizontal pivots, e.g., holes 12116 and 54, and is rotable along one or both horizontal swing paths 12216, 12218. In certain examples, the crossing gate 14 is rotable around one or more horizontal pivots while the crossing gate actuator is down. This rotation provides a resettable break-away function to compensate for people colliding with the gate while it is down.

One or more spring assemblies 144, 146, 168, 170 provide this reset ability, in certain examples. The one or more spring assemblies 144, 146, 168, 170 are coupled to the crossing gate 14 and the crossing gate release mechanism 10 to exert a bias to maintain the crossing gate in the path. In various embodiments, the spring bias is to maintain the crossing gate at a center of the horizontal swing path, and the crossing gate is rotable along a first direction 12218 from center of the horizontal swing path by rotation around the horizontal pivot, e.g. around a hole for pivot pin 54, and is rotable in a second direction 12216 from center of the horizontal swing path, opposite the first direction, by rotation around a further horizontal pivot, e.g. around hole 12116.

The arm bar segments 1203 and 1204 assist in servicing the multiple direction gate release mechanism 10. In some examples, one or more cables 172 and 174 are highly tensioned, making it difficult for repair personnel to separate the cables 172 and 174 from the secondary pivot arm assembly 1258. The cables 172 and 174 are highly tensioned to discourage movement of the top and bottom bars 12108 and 12110 with respect to the top swing plate 60 and the bottom swing plate 62 in use.

Because these springs are maintained at high tension to maintain the gate in the path, it can be difficult for service persons to decouple the springs to perform service. This is a problem if the crossing sign is to be serviced while the crossing arm is in the down mode, as the service person needs to swing the crossing gate out of the path so travelers can use the path. Accordingly, one or more bar segments 1203, 1204 provide an easy way to perform service. One or more bar segments are coupled to the spring assembly and removably coupled to the crossing gate 14. In some examples, the bar segment is bolted to the crossing gate. A service person can decouple the spring assembly from the crossing gate in maintenance to swing the crossing gate out of the path. Fasteners disposed through pilot holes 1205 and 1206 and into respective inboard ends 1201 and 1202 couple the arm bar segments 1203 and 1204 to the inboard ends 1201 and 1202 so that, for example, the cables 172 and 174 can influence the secondary pivot arm assembly 1258 to remain in a neutral position. When, in certain instances, the fasteners are removed, the arm bar segments 1203 and 1204 remain in position, with cables 172 and 174 maintaining them tight against a stop. In some example, cables 172 and 174 maintain them tight against at least tabbed brace plate 105.

In various examples, the crossing gate release mechanism 10 includes a detent such as detent 70. In various examples, the detent 70 is to releasably fix the crossing gate against rotation in a first direction 12218 around a horizontal pivot including hole 12116. In some examples, the crossing gate release mechanism 10 includes a detent 70 releasably fixed in registration with a detent actuator, e.g. an actuator including plunger 142, coupled to the crossing gate actuator 12, with the crossing gate release mechanism 10 releasably fixed against rotation around a horizontal pivot.

In some examples, the crossing gate release mechanism resists rotation around the horizontal pivot including hole 12116 in the first direction 12218, instead forcing rotation around a pivot including hole for pivot pin 54. In some examples, a bias applied by one or more springs to resist rotation in the second direction 12216 is less than a spring bias maintaining the crossing gate is registration with the detent, so that the gate rotates in the second direction instead of rotating out of registration with the detent 70. Some examples include additional stops to resist rotation in the second direction 12216 around the pivot including hole for pivot pin 54, such as one or more swing stops. In some examples, the bias applied by one or more springs to resist rotation in the second direction 12216 is less than a spring bias in combination with the resistance to rotation provided by the detent system including the detent 70 and the detent actuator.

In some examples, the crossing gate 14 is to swing in the first direction 12218 by deforming only a first spring, e.g. 202 or first spring set. In certain examples, the crossing gate 14 is to swing in the second direction 12216 by deforming only a second spring, e.g. 192 or second spring set. Some examples include a shock absorber 148 is coupled between the crossing gate and the crossing gate release mechanism to damp travel along the second direction 12216.

Figure 13:
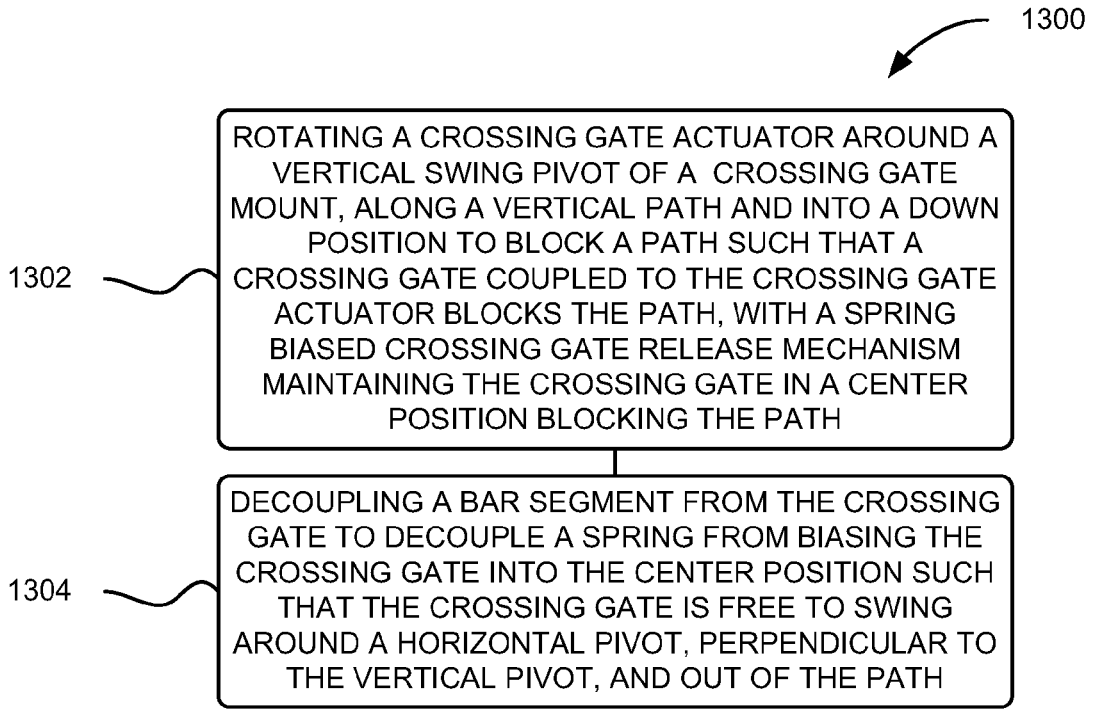
FIG. 13 is a perspective view of a method for servicing a crossing gate, according to some embodiments.

FIG. 13 is a perspective view of a method 1300 for servicing a crossing gate, according to some embodiments. At 1302, the method includes rotating a crossing gate actuator around a vertical swing pivot of a crossing gate mount, along a vertical swing path and into a down position to block a path such that a crossing gate coupled to the crossing gate actuator blocks the path, with a spring biased crossing gate release mechanism maintaining the crossing gate in a center position blocking the path. At 1304, the method include decoupling a bar segment from the crossing gate to decouple a spring from biasing the crossing gate into the center position such that the crossing gate is free to swing around a horizontal pivot, perpendicular to the vertical pivot, and out of the path.

Optional methods include swinging the crossing gate into a further path while the bar segment is decoupled from the crossing gate. Further methods include damping the swinging with a shock absorber.

It will be readily understood to those skilled in the art that various other changes in the details, material, and arrangements of the parts and method stages which have been described and illustrated in order to explain the nature of this invention may be made without departing from the principles and scope of the invention as expressed in the subjoined claims.

It is emphasized that the Abstract is provided to comply with 37 C.F.R. §1.72(b) requiring an Abstract that will allow the reader to quickly ascertain the nature and gist of the technical disclosure. It is submitted with the understanding that it will not be used to interpret or limit the scope or meaning of the claims.

What is claimed is:

1. A system, comprising:

a crossing gate mount;

a crossing gate actuator coupled to a vertical swing pivot that is coupled to the crossing gate mount, the crossing gate actuator rotable along a vertical swing path, around the vertical swing pivot, up and out of a path and down and into the path;

a crossing gate release mechanism coupled to the crossing gate actuator;

a crossing gate coupled to a horizontal swing pivot that is coupled to the crossing gate release mechanism, the crossing gate rotable along a horizontal swing path, around the horizontal swing pivot, into the path and out of the path while the crossing gate actuator is down;

a spring assembly coupled to the crossing gate and the crossing gate release mechanism, the spring assembly configured to exert a spring bias to maintain the crossing gate in the path; and a bar segment coupled to the spring assembly and removably fastened to the crossing gate, wherein in a path blocking mode of operation the bar segment is fastened to the crossing gate and the spring assembly exerts a spring bias against the bar segment to hold the bar segment against a brace, with the bar segment fastened to the crossing gate and the crossing gate extended across the path, wherein in a break-away mode of operation the bar segment is fastened to the crossing gate and the spring bias of the spring assembly is overcome, with the crossing gate pivoted out of the path, and wherein in a maintenance mode of operation the crossing gate is unfastened from the bar segment, the spring assembly exerts the spring bias against the bar segment to maintain the bar segment against a brace and the crossing gate is free to swing around the horizontal pivot, free of the spring bias, to position the crossing gate out of the path.

2. The system of claim 1, wherein the bar segment is bolted to the crossing gate.

3. The system of claim 1, wherein the bias is to maintain the crossing gate at a center of the horizontal swing path, and the crossing gate is rotable along a first direction from center of the horizontal swing path by rotation around the horizontal swing pivot and is rotable in a second direction from center of the horizontal swing path, opposite the first direction, by rotation around a further horizontal swing pivot.

4. The system of claim 3, wherein the crossing gate release mechanism is to resist rotation around the horizontal swing pivot in the first direction.

5. The system of claim 3, wherein the crossing gate release mechanism includes a detent to releasably fix the crossing gate against rotation in the first direction around the further horizontal swing pivot.

6. The system of claim 5, wherein the crossing gate release mechanism includes the detent releasably fixed in registration with a detent actuator coupled to the crossing gate actuator, the crossing gate release mechanism releasable fixed against rotation in the second direction around the further horizontal swing pivot.

7. The system of claim 6, wherein the crossing gate release mechanism includes a stop bar to resist rotation around the horizontal swing pivot in the first direction, and a second direction bias to resist rotation in the second direction around the further horizontal swing pivot is less than the bias to maintain the crossing gate in the path.

8. The system of claim 3, wherein the crossing gate is to swing in the first direction by deforming only a first spring.

9. The system of claim 3, wherein the crossing gate is to swing in the second direction by deforming only a second spring.

10. The system of claim 9, wherein a shock absorber is coupled between the crossing gate and the crossing gate release mechanism to damp travel along the second direction.

11. The system of claim 1, wherein the crossing gate release mechanism includes at least one arcuate plate defining an arcuate channel to guide a cable of the spring assembly into the arcuate channel.

12. An apparatus, comprising:

a crossing gate release mechanism to couple to a crossing gate actuator, the crossing gate actuator to couple to a vertical swing pivot of a crossing gate mount, the crossing gate actuator to rotate along a vertical swing path, around the vertical swing pivot, up and out of a path and down and into the path;

a crossing gate coupled to a horizontal swing pivot that is coupled to the crossing gate release mechanism, the crossing gate rotable along a horizontal swing path, around the horizontal swing pivot, into the path and out of the path while the crossing gate actuator is down;

a spring assembly coupled to the crossing gate and the crossing gate release mechanism, the spring assembly including a bias to maintain the crossing gate in the path; and a bar segment coupled to the spring assembly and removably coupled to the crossing gate to decoupled the spring assembly from the crossing gate in maintenance to swing the crossing gate out of the path, wherein in a path blocking mode of operation the bar segment is fastened to the crossing gate and the spring assembly exerts a spring bias against the bar segment to hold the bar segment against a brace, with the bar segment fastened to the crossing gate and the crossing gate extended across the path, wherein in a break-away mode of operation the bar segment is fastened to the crossing gate and the spring bias of the spring assembly is overcome, with the crossing gate pivoted out of the path, and wherein in a maintenance mode of operation the crossing gate is unfastened from the bar segment, the spring assembly exerts the spring bias against the bar segment to maintain the bar segment against a brace and the crossing gate is free to swing around the horizontal pivot, free of the spring bias, to position the crossing gate out of the path.

13. The apparatus of claim 12, wherein the bias to maintain the crossing gate at a center of the horizontal swing path, and the crossing gate is rotable along a first direction from the center of the horizontal swing path by rotation around the horizontal swing pivot and is rotable in a second direction from the center of the horizontal swing path, opposite the first direction, by rotation around a further horizontal swing pivot.

14. The apparatus of claim 13, wherein the crossing gate release mechanism includes a stop bar to resist rotation around the horizontal swing pivot in the first direction.

15. The apparatus of claim 13, wherein the crossing gate release mechanism includes a detent to releasably fix the crossing gate against rotation in the first direction around the further horizontal swing pivot.

16. The apparatus of claim 15, wherein the crossing gate release mechanism includes a detent releasably fixed in registration with a detent actuator coupled to the crossing gate actuator, the crossing gate release mechanism releasable fixed against rotation in the second direction around the further horizontal swing pivot.

17. The apparatus of claim 16, wherein the crossing gate release mechanism includes a stop bar to resist rotation around the horizontal swing pivot in the first direction, and a second direction bias is to resist rotation in the second direction around the further horizontal swing pivot is less than a first direction bias to maintain the crossing gate in registration with the detent.

18. A method of servicing a crossing gate, comprising:

rotating a crossing gate actuator around a vertical swing pivot of a crossing gate mount, along a vertical swing path and into a down position to block a path such that a crossing gate coupled to the crossing gate actuator blocks the path, with a spring biased crossing gate release mechanism maintaining the crossing gate in a center position blocking the path;

temporarily breaking the crossing gate from blocking the path by overcoming a spring biasing the crossing gate into the center position, with the crossing gate free to return to the center position when the spring bias is no longer overcome; and decoupling a bar segment from the crossing gate to permanently decouple the spring from biasing the crossing gate into the center position until the bar segment is recoupled, with the crossing gate free to swing around a horizontal swing pivot, perpendicular to the vertical swing pivot, and out of the path while the bar segment is decoupled from the crossing gate.

19. The method of claim 18, further comprising swinging the crossing gate into a further path while the bar segment is decoupled from the crossing gate.

20. The method of claim 18, further comprising damping the swinging with a shock absorber.

* * * * *